US009574716B2

(12) United States Patent
Dass

(10) Patent No.: US 9,574,716 B2
(45) Date of Patent: Feb. 21, 2017

(54) METHOD OF REDUCING LEAKS FROM A PIPELINE

(71) Applicant: 1589549 Alberta Ltd., Edmonton (CA)

(72) Inventor: Pradeep Dass, Edmonton, CA (US)

(73) Assignee: 1589549 Alberta Ltd., Edmonton (CA)

( * ) Notice: Subject to any disclaimer, the term of this patent is extended or adjusted under 35 U.S.C. 154(b) by 89 days.

(21) Appl. No.: 14/384,444

(22) PCT Filed: Mar. 18, 2013

(86) PCT No.: PCT/CA2013/050225

§ 371 (c)(1),
(2) Date: Sep. 11, 2014

(87) PCT Pub. No.: WO2013/134883

PCT Pub. Date: Sep. 19, 2013

(65) Prior Publication Data

US 2015/0107683 A1 Apr. 23, 2015

Related U.S. Application Data

(60) Provisional application No. 61/612,102, filed on Mar. 16, 2012.

(51) Int. Cl.
*F17D 5/02* (2006.01)
*F04B 23/02* (2006.01)
(Continued)

(52) U.S. Cl.
CPC ..... *F17D 5/02* (2013.01); *E21B 43/01* (2013.01); *F04B 23/02* (2013.01); *F17D 1/14* (2013.01);
(Continued)

(58) Field of Classification Search
CPC ..... F17D 1/14; F17D 3/00; F17D 5/02; F17D 5/06; E21B 43/01; Y10T 137/0452
See application file for complete search history.

(56) References Cited

U.S. PATENT DOCUMENTS 2,404,635 A * 7/1946 Hoover ..... F04D 13/086 417/360
3,666,100 A 5/1972 Madej
(Continued)

FOREIGN PATENT DOCUMENTS

WO 2009038473 A1 3/2009

OTHER PUBLICATIONS

"Centrifugal Pump Reverse Flow," <http://www.cheresources.com/invision/topic/13124-centrifugal-pump-reverse-flow/> [retrieved Aug. 3, 2013], 6 pages.

(Continued)

*Primary Examiner* — Eric Keasel
(74) *Attorney, Agent, or Firm* — Christensen O'Connor Johnson Kindness PLLC

(57) ABSTRACT

A method of reducing leakage from a pipeline includes the steps of: pumping fluid through a pipeline using at least one pump, the at least one pump comprising a reversible, positive displacement fluid pump; detecting a leak in the pipeline downstream of the pump; reversing the at least one pump to draw fluid out of a downstream section of the pipeline; and redirecting the fluid being drawn from the pipeline into a storage container.

11 Claims, 3 Drawing Sheets

(51) Int. Cl.

| | |
|---|---|
| ***F17D 1/14*** | (2006.01) |
| ***E21B 43/01*** | (2006.01) |
| ***F17D 3/00*** | (2006.01) |

(52) U.S. Cl.

CPC ..... *F17D 3/00* (2013.01); *Y10T 137/0452* (2015.04); *Y10T 137/7025* (2015.04); *Y10T 137/8158* (2015.04); *Y10T 137/86035* (2015.04)

(56) References Cited

U.S. PATENT DOCUMENTS

| | | | | |
|---|---|---|---|---|
| 3,702,744 | A | 11/1972 | Brown et al. | |
| 3,741,233 | A | 6/1973 | Smith, Jr. | |
| 3,776,249 | A | 12/1973 | Wailes et al. | |
| 3,826,595 | A * | 7/1974 | Bottoms | F04D 29/061 417/370 |
| 3,921,435 | A | 11/1975 | Howard | |
| 3,958,449 | A * | 5/1976 | Drescher | F17D 5/02 73/40.5 R |
| 4,877,043 | A * | 10/1989 | Carmichael | F02B 77/04 123/198 A |
| 6,175,173 | B1 * | 1/2001 | Stephan | H02K 5/1285 417/356 |
| 6,200,108 | B1 * | 3/2001 | Caudill | F04D 13/06 417/370 |
| 7,069,183 | B2 | 6/2006 | Schluecker et al. | |
| 7,087,033 | B2 | 8/2006 | Brugger et al. | |
| 7,363,803 | B2 | 4/2008 | Hayakawa et al. | |
| 7,441,549 | B2 | 10/2008 | Takayanagi | |
| 7,810,378 | B2 | 10/2010 | Hunaidi et al. | |
| 8,292,594 | B2 | 10/2012 | Tracey et al. | |
| 8,388,327 | B2 * | 3/2013 | Ree | F04C 2/1071 417/410.4 |
| 8,893,775 | B2 * | 11/2014 | Bjoroy | E21B 43/01 166/105 |
| 2010/0239446 | A1 * | 9/2010 | Ree | F04C 2/1071 418/1 |
| 2011/0056699 | A1 | 3/2011 | Bjoroy et al. | |

OTHER PUBLICATIONS

Chatterjee, S.K., "Theory of Reverse Flow," <http://www.maintenanceworld.com/Articles/kumar/Reverse-flow.pdf> [retrieved Aug. 3, 2013], 22 pages.

"Hydraulic Institute—About Pumps Q&A," <http://www.pumps.org/content_detail.aspx?id=744> [retrieved Aug. 3, 2013], 1 page.

"Running Pump in Reverse Flow," <http://www.eng-tips.com/viewthread.cfm?qid=293607> [retrieved Aug. 3, 2013], 3 pages.

Talbot, R., "Hazards of Reverse Pump Rotation," <http://turbolab.tamu.edu/proc/pumpproc/P27/Hazards%20of%20Reverse%20Pump%20Rotation.pdf> [retrieved Aug. 3, 2013], 25 pages.

* cited by examiner

METHOD OF REDUCING LEAKS FROM A PIPELINE

TECHNICAL FIELD

This relates to a method of pumping fluid through a pipeline, such as a subsea or surface pipeline to reduce leakage from the pipeline in the event of a pipeline leak.

BACKGROUND

When transporting crude oil or other hazardous fluids through a pipeline, there is a risk of leaks from the pipeline or at a pipeline station. This can result in environmental damage, whether the leak occurs in a subsea or surface pipeline.

U.S. Pat. No. 3,702,744 (Brown et al.) describes a pump connected to a pipeline in an environmentally sensitive area. The pump is activated in the event of a leak to pump fluids out of the pipeline and into a container. U.S. Pat. No. 3,741,233 (Smith, Jr.) describes another system in which fluid flowing along a pipeline is redirected into a container in the event of a leak.

SUMMARY

There is provided a method of reducing leakage from a pipeline, comprising: pumping fluid through a pipeline using at least one pump, the at least one pump comprising a reversible, positive displacement fluid pump; detecting a leak in the pipeline downstream of the pump; reversing the at least one pump to draw fluid out of a downstream section of the pipeline; and redirecting the fluid being drawn from the pipeline into a storage container.

According to an aspect, the at least one pump may comprise two or more pumps connected in parallel to the other pumps. The two or more pumps may be separately isolatable from the pipeline.

According to an aspect, the method may further comprise the step of providing a bypass line in parallel with the at least one pump.

According to an aspect, detecting a leak may comprise receiving a signal indicative of a leak from a leak detector.

According to an aspect, the pipeline may be undersea, and drawing fluid out of the downstream section further comprises creating a vacuum in the downstream section that draws water into the pipeline through the leak.

According to an aspect, redirecting the fluid into the storage container may comprise closing a valve on the pipeline and opening a valve to the storage container.

According to an aspect, the method may further comprise the step of programming a controller to receive a signal indicative of a leak from a leak detector to, upon receiving a signal indicating a leak from the leak detector, reverse the at least one pump to pump fluid from a downstream portion of the pipeline and to redirect the fluid into the storage container.

According to an aspect, the at least one pump may be a progressive cavity pump.

According to an aspect, there is provided an apparatus for reducing leakage from a pipeline. The apparatus comprises at least one pump connected to pump fluid through a pipeline. The at least one pump comprises a reversible, positive displacement pump. The at least one pump pumps fluid in a downstream direction in an operating mode and pumping fluid in an upstream direction in a reverse mode. A storage container is connected to the pipeline by a first valve upstream of the at least one pump. A second valve is connected to the pipeline and positioned upstream of the storage container. A leak detector is connected to the pipeline to detect a leak in the pipeline downstream of the at least one pump. A controller is connected to receive signals from the leak detector and to send control signals to the at least one pump and the first and second valves. The controller is programmed with instructions to, upon receiving a signal indicating a leak from the leak detector, open the first valve, close the second valve and activate the reverse mode of the at least one pump to pump fluid from a downstream portion of the pipeline into the storage container.

According to an aspect, the at least one pump may be one of a progressive cavity pump, a twin screw liquid pump, or a multiphase pump.

According to an aspect, the at least one pump may comprises two or more pumps connected in parallel to the other pumps. There may be pump valves that separately isolate each pump from the pipeline.

According to an aspect, there may be a bypass line in parallel with the at least one pump.

Other aspects will be apparent from the description and drawings.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

The method described herein applies generally to pipelines, such as subsea or surface pipelines, where the surface pipelines may be above ground or buried. While the type of pipeline considered here is one in which the flow of fluid is generally controlled from control rooms, the steps described herein may be applied to other known types of pipelines that use a pump to transport the fluid.

Figure 1:
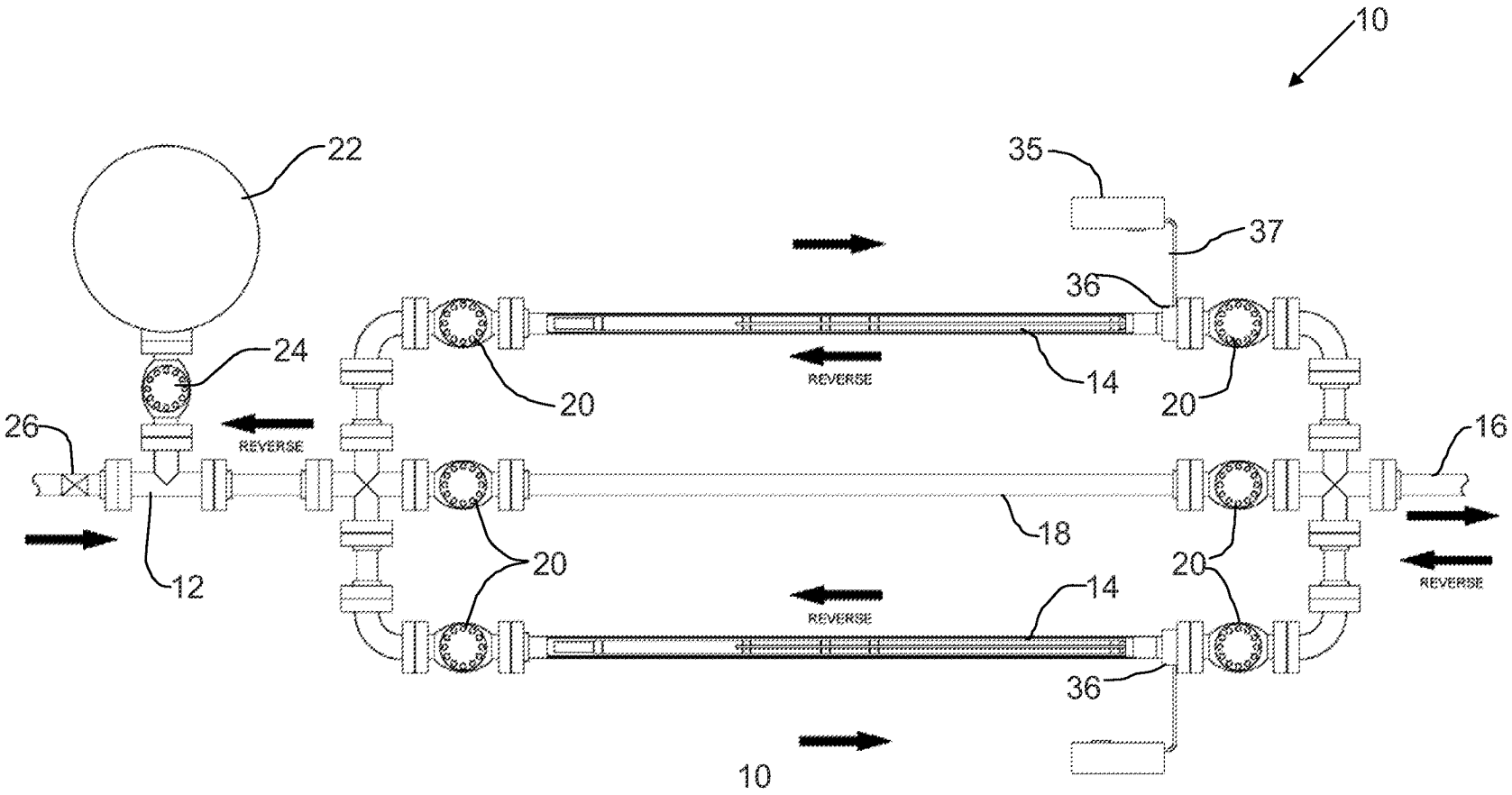
FIG. 1 is a schematic view of a pumping station

Referring to FIG. 1, there is shown an apparatus for reducing leakage from a pipeline 12. As shown, two pumps 14 are connected to pump fluid through pipeline 12. The number of pumps may vary and there could be one pump 14, or more than two pumps 14. Pumps 14 are preferably reversible, positive displacement pumps and may be, for example, progressive cavity pumps, twin screw liquid pumps, or multiphase pumps. Pumps 14 pump fluid in a downstream direction under normal operating conditions. In the event of a leak, pumps 14 may be switched to a reverse mode, where fluids are pumped out of the downstream portion 16 of pipeline 12.

The number of pumps used will depend on the amount of fluid to be pumped, the desired flow rate and pressures, the amount of redundancy desired or required by the user, and the pump specifications. Pumps 14 may be in a rack arrangement, or arranged vertically, to reduce the footprint, or may be spaced out along a ground surface. In the event that there are multiple pumps, a manifold may be designed and connected at each end of pumps 14 to ensure an appropriate distribution of fluid among pumps 14. Preferably, there is a bypass line 18 that allows fluid to bypass pumps 14 altogether, such as if pumps 14 cease operation at the same time. This allows fluid flow to continue and prevents a pressure build-up due to other sources of fluid pressure or pumps in the system. The number of bypass lines 18 may vary, but generally speaking the cross-sectional area of bypass line(s) 18 should be equal to or greater than the pipeline 12 connected to pumps 14, or multiple pipelines if arranged in such a manner. Each pump 14 and bypass line 18 preferably have valves 20 that allows them to be isolated independently of the other pump 14 or bypass line, as shown in FIG. 1.

Figure 2:
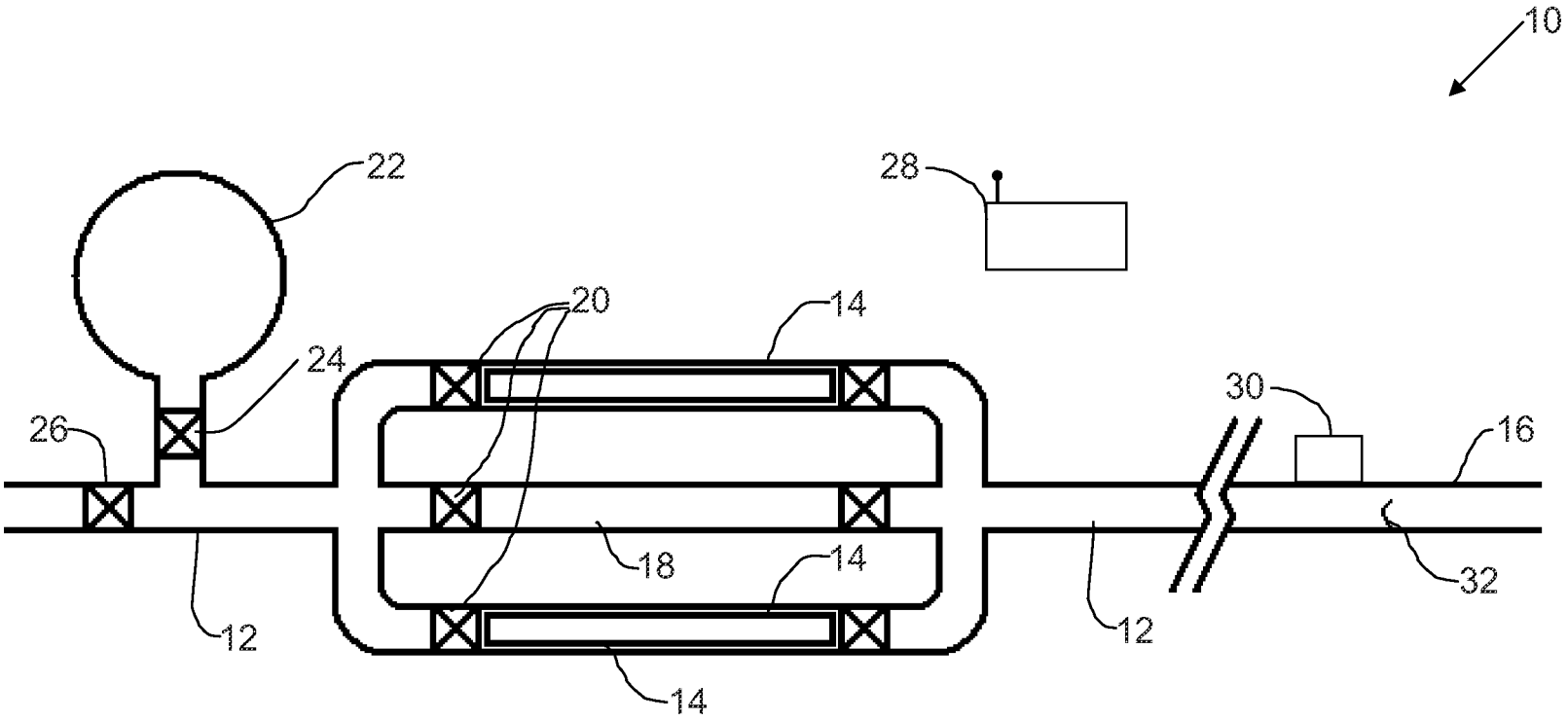
FIG. 2 is a schematic view of the pumping station connected to a pipeline.

There is a storage container 22 connected to pipeline 12 by a valve 24 that is upstream of pumps 14. Pipeline 12 has an additional valve 26 connected to pipeline 12 that is upstream of storage container 22. Storage container 22 may take various forms and will vary in size depending on the amount of fluid that it is anticipated it will need to hold. As will be understood, the distribution of valves depicted in FIGS. 1 and 2 is only an example, and may vary depending on the overall design. Another example is shown in FIG. 3, where container 22 is connected to pipeline 12 by more than a single valve and by more than one path.

Figure 3:
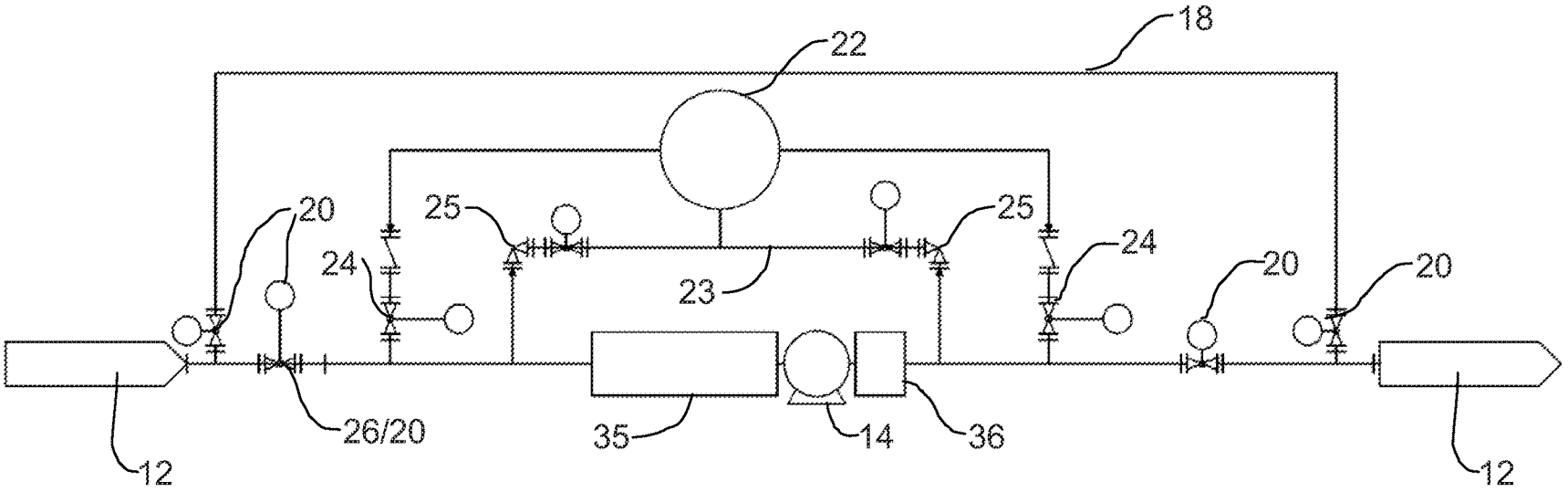
FIG. 3 is a schematic view of an alternative pumping station.

Referring to FIG. 3, if pump 14 is a multiphase or gas pump, it may be necessary to circulate fluid, or ensure sufficient fluid circulates, to keep the relevant portions of pump 14 cooled and lubricated as is known in the art. A recirculation path 23 is provided that may be used to accomplish this. Recirculation path 23 is also connected to container 22, which may be used to supply liquid if necessary, such that container 22 may serve more than one purpose. Recirculation path 23 may also have pressure relief valves 25 to release any excess pressure and avoid damaging to the equipment.

Referring to FIG. 2, the various components are preferably controlled by a logic controller 28 that is connected to, for example, the pumps 14 and valves 20, 24 and 26. It will be understood that controller 28 may control all or only some the various components could also be controlled manually and that controller 28 may issue alarms rather than instructions to equipment. Logic controller 28 is also connected to a leak detector 30 that is designed to detect the presence of a leak in the pipeline downstream of pumps 14. In the event of a leak 32, which may result from various types of failures of pipeline 12, controller 28 will send signals to close valve 26 to prevent more fluid from flowing down pipeline 12 and open valve 24 in anticipation of receiving fluid from the downstream portion 16 of pipeline 12. Controller 28 also sends a signal to pimps 14 to switch from an operative mode to a reverse mode, such that a negative pressure is applied to the downstream portion 16 of pipeline 12, resulting in fluids being pumped away from failure 32. If pipeline 12 is an underwater pipeline, this may result in water being pulled into pipeline 12, which creates a buffer and further reduces the risk of leakage from pipeline 12.

The method described herein uses one or many pumps 14 installed connected to one or more pipelines 12. As shown in FIGS. 1 and 2, the pipeline 12 is a split pipeline and there are two pumps 14, however it will be understood that there could be more than one pipeline 14 and any number of pumps 14. In such a situation, there would likely be a manifold that allowed the operator to control the flow of fluid from pumps 14 and through pipeline(s) 14. As shown, pumps 14 are complete pumps 14 that include the motor, cable, motor lead extension, motor protector complete, etc., which are preferably installed inside the pipeline. This may be done in parallel or series depending upon the requirements. by installing pumps 14 inside pipeline 12, the number of points for leakages to occurs is reduced. As will be described below, pump 14 is powered by a cable 37, which is run into pipeline 12 to connect with pump 14 using a connection 36 similar to a connection used when installing pumps 14 downhole. As these connections 36 are rated for pressures that are much higher than those encountered in a pipeline, the likelihood of a risk from pumps 14 is relatively low.

The method may be used to reduce the footprint that is inherent in a large station, reduce the risk of a leak at the stations, and reduce the amount of leakage should there be a leak downstream from the leak. The pipeline 12 may be on surface or in a subsea environment. The apparatus is preferably based on a downhole type of positive displacement pumps, such as a twin screw liquid or multiphase pump. These pumps are preferred due to their ability to pump in reverse or forward. The same results can be achieved with centrifugal pumps, but these cannot be run in reverse in this orientation. However, using any positive displacement pumps 14 can be used to achieve the following.

As shown, two pumps 14 are connected in parallel by splitting the pipeline 12 at the station, generally indicated by reference numeral 10. Pumps 14 may be driven by a VSD (Variable Speed drives—35), which may be outside the pipelines 12, and may be hundreds of feet away if connected to pumps 14 using a down hole cable 37. The VSD can be located far away or close to the station depending on power availability and cable capability to transfer power. For example, the down hole cable presently used for down hole pumps can go to 16,000 feet or even deeper allows a user to set the VSD far away from the pumping station if required. The MLE (Motor Lead Extension) comes out around the motor, the pump to the discharge point and then connects to the cable and comes out through the well head to the VSD (variable speed drive) or controls.

If more than one pump 14 is used, it allows one pump 14 to remain idle while the other one or more pumps 14 carry the load, or they may each contribute to the flow through pipeline 12. By controlling the capacity of each pump, In the alternative two together or all together could do a percentage of the 100% capacity of the flow line capacity.

In a preferred embodiment, the various components of pumps 14, such as the motor, cable, pressure compensation system, gear box if applicable, Motor Lead Extension, pot head, sensors, any capillary lines for multiphase applications for lubrication complete are preferably inside the split pipelines 12 at station 10 such that only the cable would be visible outside of pipeline 14.

Referring to FIG. 3, cable 34 may come out through a simple well head connection 36 as used in down hole pumps. There are many types of well heads in the field where the cable comes out through sealed systems and that are rated for very high pressures. This is sealed similar to a down hole pump cable coming out of a down hole installed pump. In a subsea environment, pumps 14 can be landed vertical or horizontal. On surface, pumps 14 can installed slanted or horizontal.

By using this design, the risk related to leaks from mechanical seals or any other leaks at station 10 is reduces, as everything is canned inside the pipe lines. Another major advantage is that, should there be a leak anywhere in the pipe line hundreds of kilometers away, pumps 14 can be made to run in reverse and the fluid collected back at another contained location for emergency on a temporary basis. This will stop the leak at a distant pipe line leak 32 within minutes. This can be set to automatic settings. The containment tank 22 is preferably designed to hold any emergency fluid being pumped back. Once there is a leak in the pipeline 12, the fluid coming from the source of fluids (e.g. oil field or other area) is first shut down and then these station pumps are stopped and run in reverse switching the intake into discharge and discharge into intake in a very short time. Due to lack of pressure at the leak area, the leak will be stopped relatively quickly. The concept here is the capability to pump in reverse. In a subsea environment, when it pumps in reverse the pump will pull all fluids out and then it will start pulling sea water up through leak 32. At that point one can shut down and ensure leak is completely arrested. Pressures can be compensated and maintenance can commence. Before the containment tank there is a valve 26 that will be open in normal operation. When fluid is pumped in reverse valve 26 will close to allow fluid to enter the containment tank 22.

This system can be used for gas, liquid or multiphase as long as the medium can be pumped using a pump or compressor.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. The scope of the claims should not be limited by the preferred embodiments set forth in the examples above.

What is claimed is:

1. A method of reducing leakage from a pipeline, comprising:

pumping fluid through the pipeline using at least one pump, the at least one pump comprising a reversible, positive displacement multiphase or gas pump having a motor installed within the pipeline;

detecting a leak in the pipeline downstream of the pump;

reversing the at least one pump to draw fluid out of a downstream section of the pipeline;

redirecting the fluid being drawn from the pipeline into a storage container; and recirculating liquid through a recirculation path to cool and lubricate the motor of the at least one pump.

2. The method of claim 1, wherein the at least one pump comprises two or more pumps connected in parallel, and further comprising the step of separately isolating each of the two or more pumps from the pipeline.

3. The method of claim 1, further comprising the step of providing a bypass line in parallel with the at least one pump.

4. The method of claim 1, wherein detecting a leak comprises receiving a signal indicative of a leak from a leak detector.

5. The method of claim 1, wherein the pipeline is undersea, and drawing fluid out of the downstream section further comprises creating a vacuum in the downstream section that draws water into the pipeline through the leak.

6. The method of claim 1, wherein redirecting the fluid into the storage container comprises closing a valve on the pipeline and opening a valve to the storage container.

7. The method of claim 1, further comprising the step of programming a controller to receive a signal indicative of a leak from a leak detector to, upon receiving a signal indicating a leak from the leak detector, reverse the at least one pump to pump fluid from a downstream portion of the pipeline and to redirect the fluid into the storage container.

8. An apparatus for reducing leakage from a pipeline, comprising:

at least one pump connected to pump fluid through the pipeline, the at least one pump comprising a reversible, positive displacement multiphase or gas pump having a motor installed within the pipeline, the at least one pump pumping fluid in a downstream direction in an operating mode and pumping fluid in an upstream direction in a reverse mode;

a storage container connected to the pipeline by a first valve upstream of the at least one pump;

a second valve connected to the pipeline and positioned upstream of the storage container;

a leak detector connected to the pipeline to detect a leak in the pipeline downstream of the at least one pump;

a controller connected to receive signals from the leak detector and to send control signals to the at least one pump and the first and second valves, the controller being programmed with instructions to, upon receiving a signal indicating a leak from the leak detector, open the first valve, close the second valve and activate the reverse mode of the at least one pump to pump fluid from a downstream portion of the pipeline into the storage container; and a recirculation path that recirculates liquid through the at least one pump to cool and lubricate the motor of the at least one pump.

9. The apparatus of claim 8, wherein the at least one pump comprises two or more pumps connected in parallel.

10. The apparatus of claim 9, comprising pump valves that separately isolate each pump from the pipeline.

11. The apparatus of claim 8, further comprising a bypass line in parallel with the at least one pump.

* * * * *